US009362062B1

(12) United States Patent
Wu

(10) Patent No.: US 9,362,062 B1
(45) Date of Patent: Jun. 7, 2016

(54) ULTRA-THIN KEYBOARD SWITCH

(71) Applicant: DONGGUAN KAIHUA ELECTRONICS CO., LTD, Dongguan (CN)

(72) Inventor: Fuxi Wu, Dongguan (CN)

(73) Assignee: DONGGUAN KAIHUA ELECTRONICS CO., LTD., Dongguan, Guangdong (CN)

( * ) Notice: Subject to any disclaimer, the term of this patent is extended or adjusted under 35 U.S.C. 154(b) by 47 days.

(21) Appl. No.: 14/555,650

(22) Filed: Nov. 27, 2014

(51) Int. Cl.
*H01H 13/70* (2006.01)
*H01H 3/12* (2006.01)

(52) U.S. Cl.
CPC ..... *H01H 3/122* (2013.01)

(58) Field of Classification Search
CPC ..... H01H 3/125
USPC ..... 200/345
See application file for complete search history.

*Primary Examiner* — Vanessa Girardi

(57) ABSTRACT

An ultra-thin keyboard switch includes a base, a static contact plate, a support plate, a movable contact plate, a lower frame, an upper frame, and a keyboard cap. The static contact plate and the support plate are separated from each other and disposed on the base. The upper frame and the lower frame are intersected and pivotally connected with each other to form an X-shaped configuration to bring the movable contact plate to move. The thickness of the product can be reduced to be thin. No matter where the user's finger is at any position of the keyboard, the upper frame and the lower frame are linked to bring the movable contact plate to move. The present invention can be pressed stably, so that the connection of the static contact plate and the movable contact plate is more sensitive and the product can be used more conveniently.

10 Claims, 11 Drawing Sheets

ULTRA-THIN KEYBOARD SWITCH

BACKGROUND OF THE INVENTION

1. Field of the Invention

The present invention relates to a keyboard switch, and more particularly to an ultra-thin keyboard switch.

2. Description of the Prior Art

A keyboard switch is applied to and mounted on a switch of a keyboard. The keyboard switch comprises a base, an upper cover, a static contact plate, a movable contact plate, and a button. The upper cover and the base jointly define an accommodation cavity therebetween. The static contact plate, the movable contact plate, and the button are disposed in the accommodation cavity. One end of the button is exposed out of the accommodation cavity. By pressing the button, the button can be moved up and down, and then the button is to act on the movable contact plate, rendering the movable contact plate and the static contact plate to be connected or disconnected.

The aforesaid keyboard switch provides the user to disconnect or connect the static contact plate with the movable contact plate. However, when in use, the structure itself and function still have some drawbacks. The existing keyboard switch is unable to achieve the best use effect and work efficiency when in use. The button of the existing keyboard switch is in the form of a guide post, so the whole product is thick. The button is mounted at the center of the bottom of the keyboard cap. When the user's finger presses one side edge of the keyboard, the button cannot be pressed down stably to connect the static contact plate with the movable contact plate. It is inconvenient for use. Accordingly, the inventor of the present invention has devoted himself based on his many years of practical experiences to solve this problem.

SUMMARY OF THE INVENTION

The primary objective of the present invention is to provide an ultra-thin keyboard switch to overcome the shortcomings of the prior art. The existing keyboard switch is thick and inconvenient for use.

In order to achieve the aforesaid objective, the ultra-thin keyboard switch of the present invention comprises a base, a static contact plate, a support plate, a movable contact plate, a lower frame, an upper frame, and a keyboard cap. The static contact plate and the support plate are separated from each other and disposed on the base. The static contact plate has a first welding leg and a static contact. The support plate has a second welding leg. The second welding leg and the first welding leg extend out of the base. One end of the movable contact plate is in contact with and electrically connected with the support plate. Another end of the movable contact plate has a movable contact. The movable contact is located above the static contact. The upper frame and the lower frame intersect each other and are pivotally connected together. A lower end of the upper frame and a lower end of the lower frame are pivotally connected to two ends of the base, respectively. An upper end of the upper frame and an upper end of the lower frame are pivotally connected to two ends of a bottom of the keyboard cap, respectively. The upper frame and the lower frame are assembled to form an X-shaped configuration to bring the movable contact plate to move. When the upper frame and the lower frame are in a folded state, the movable contact and the static contact are in contact with each other and electrically connected. The movable contact plate is provided with an elastic member to restore the movable contact plate for the movable contact to be away from the static contact.

Compared to the prior art, the present invention has obvious advantages and beneficial effects.

The upper frame and the lower frame are intersected and pivotally connected with each other to form the X-shaped configuration to bring the movable contact plate to move, instead of the conventional guide post. The thickness of the product can be reduced to be thin. No matter where the user's finger is at any position of the keyboard, the upper frame and the lower frame are linked to bring the movable contact plate to move. The present invention can be pressed stably, so that the connection of the static contact plate and the movable contact plate is more sensitive and the product can be used more conveniently.

DETAILED DESCRIPTION OF THE PREFERRED EMBODIMENTS

Figure 1:
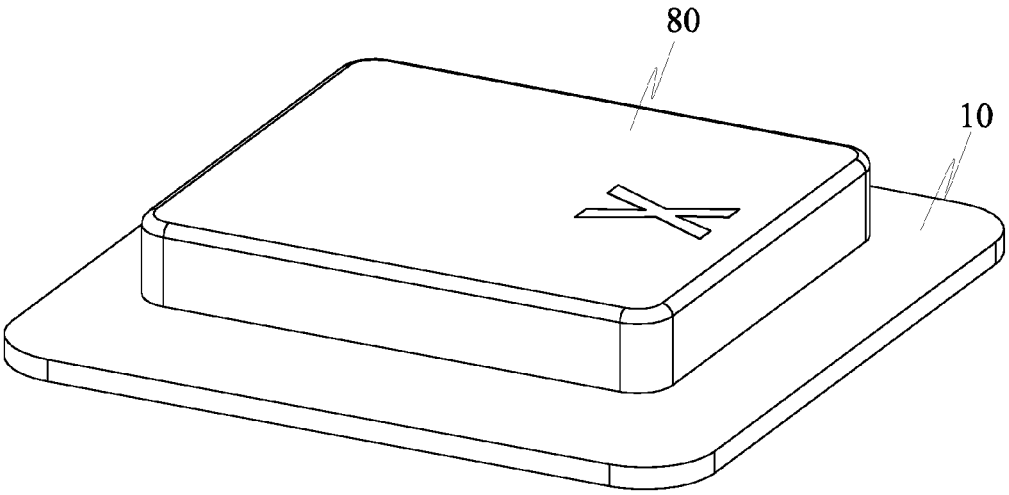
FIG. 1 is an assembled perspective view according to a first embodiment of the present invention.
Figure 2:
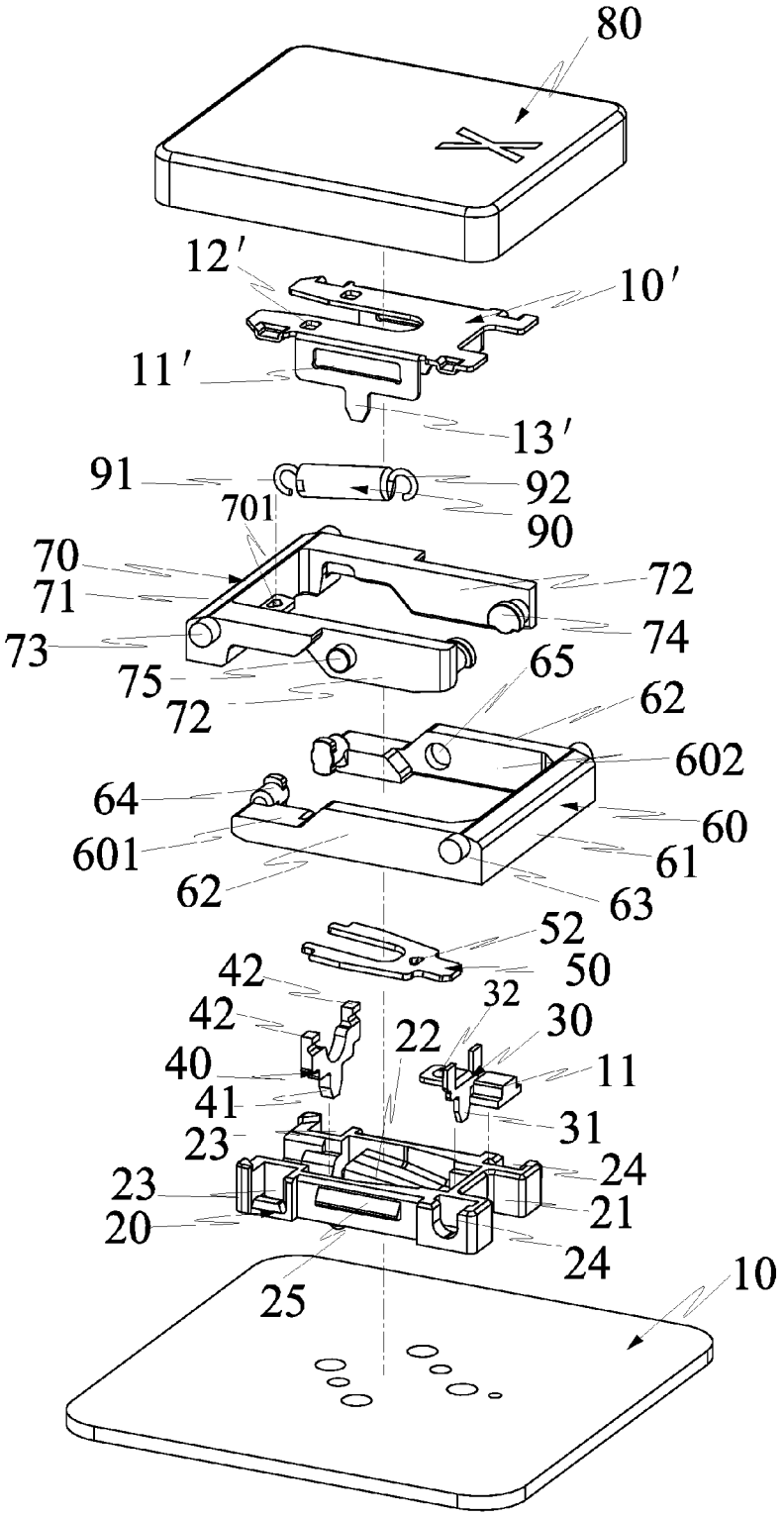
FIG. 2 is an exploded view according to the first embodiment of the present invention.
Figure 3:
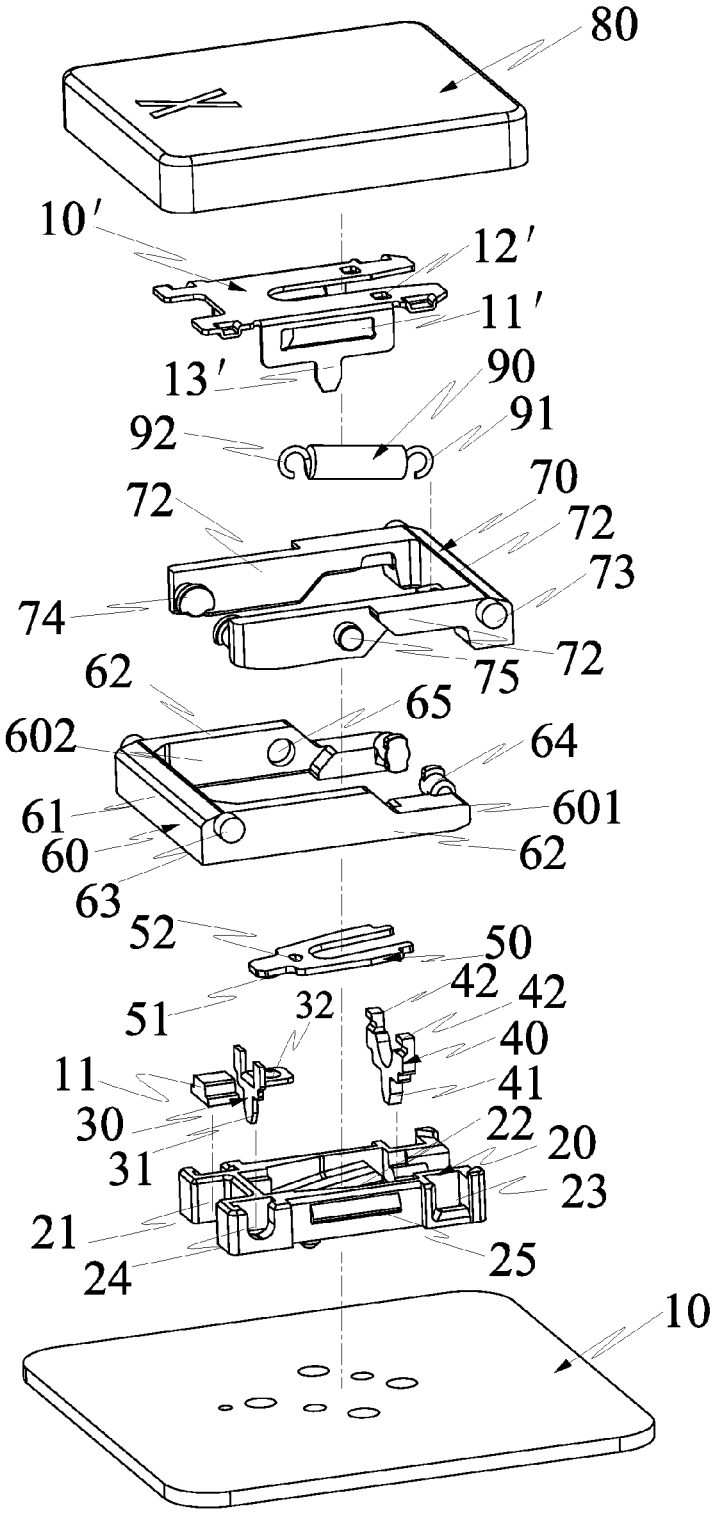
FIG. 3 is another exploded view according to the first embodiment of the present invention.
Figure 4:
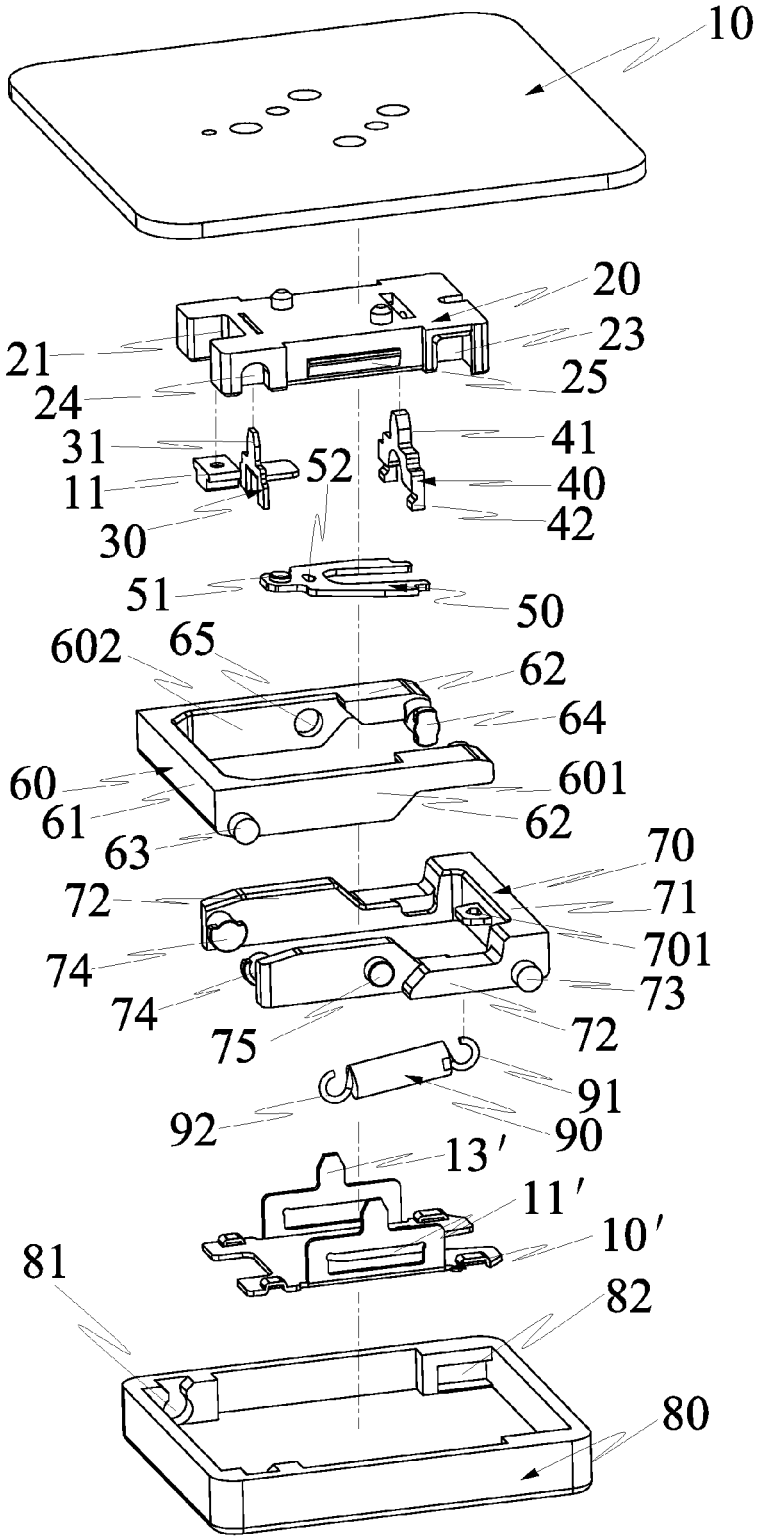
FIG. 4 is a further exploded view according to the first embodiment of the present invention.
Figure 5:
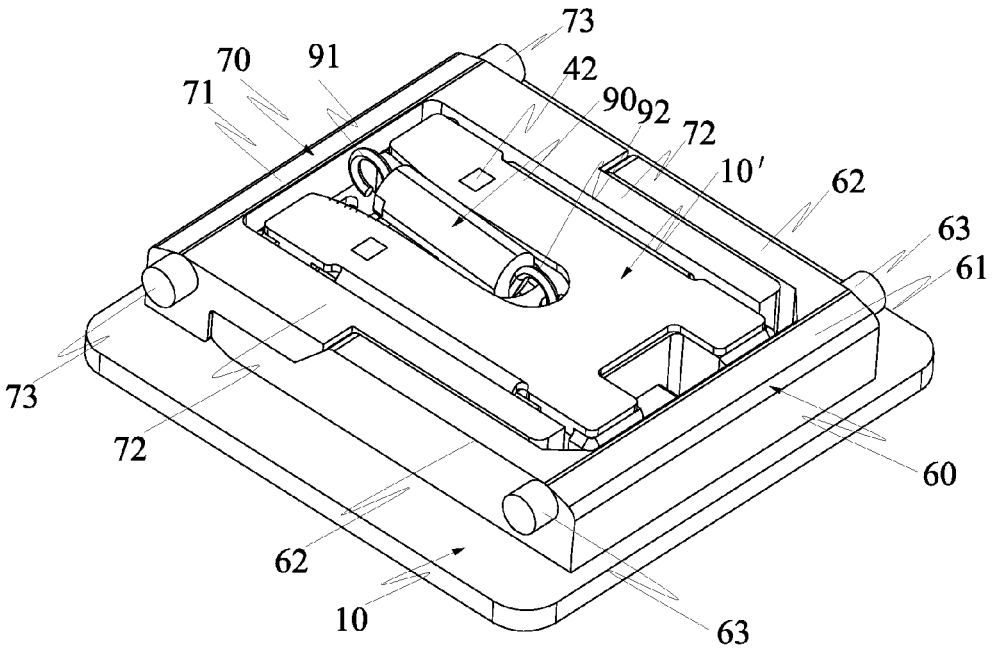
FIG. 5 is a partial assembled view according to the first embodiment of the present invention.
Figure 6:
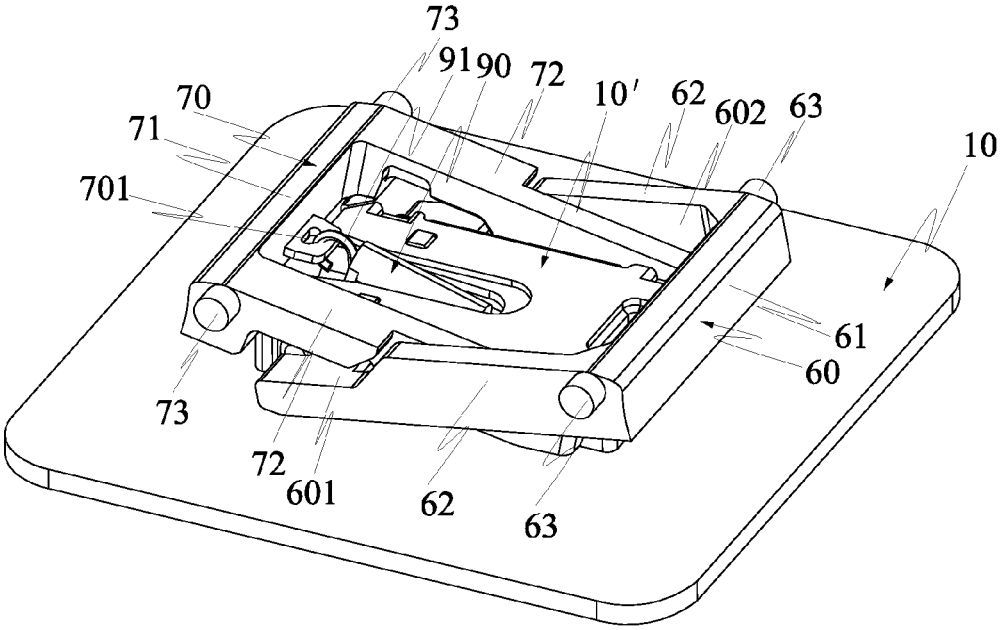
FIG. 6 is a schematic view of FIG. 5 showing the upper frame and the lower frame in an unfolded state.
Figure 7:
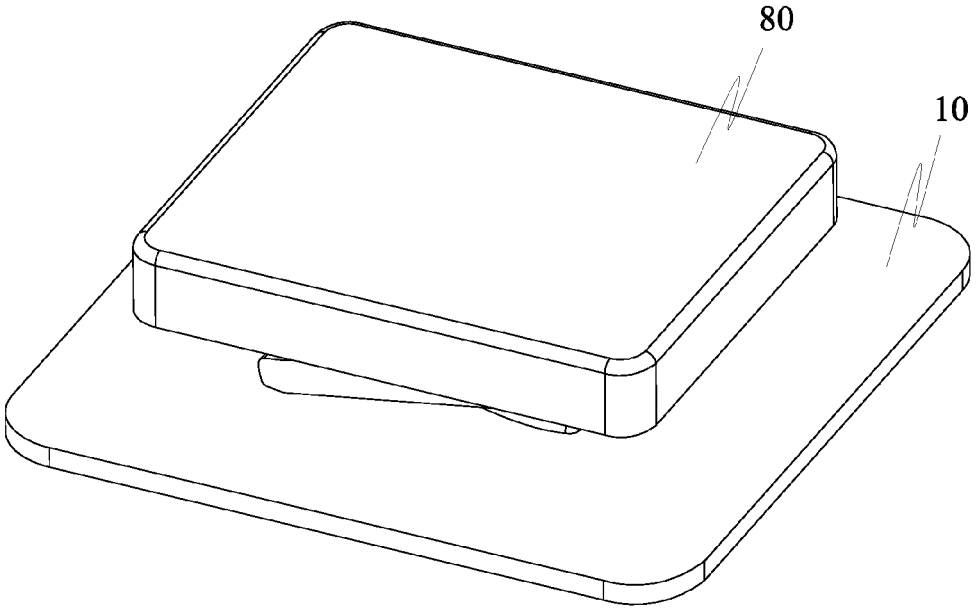
FIG. 7 is a schematic view of the first embodiment of the present invention when in use.
Figure 8:
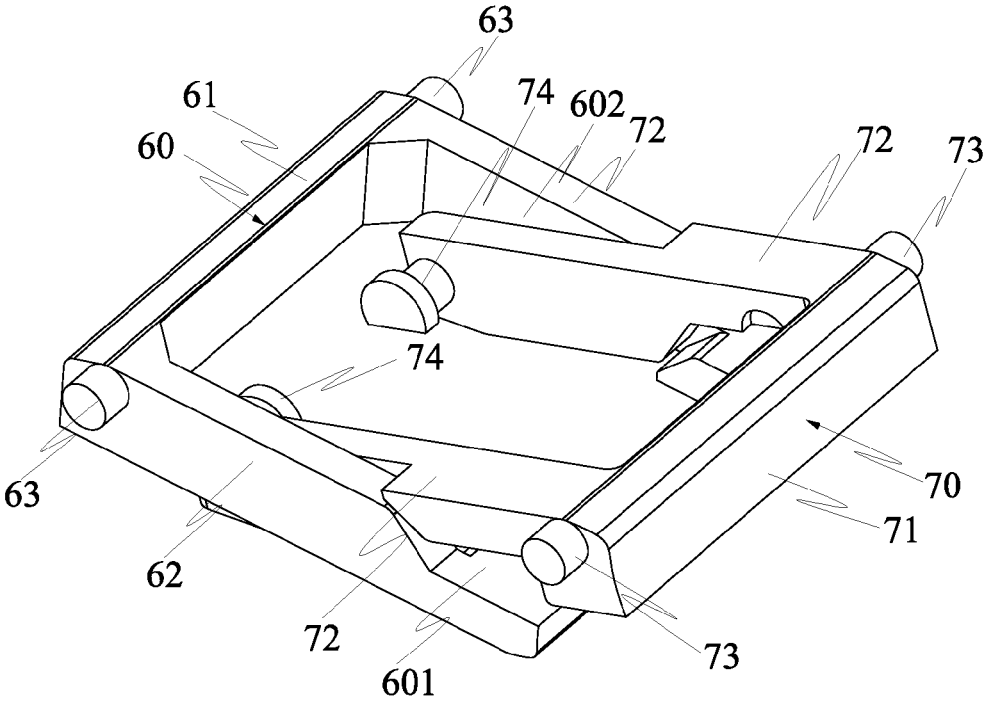
FIG. 8 is an enlarged view of the upper frame and the lower frame according to the first embodiment of the present invention.
Figure 9:
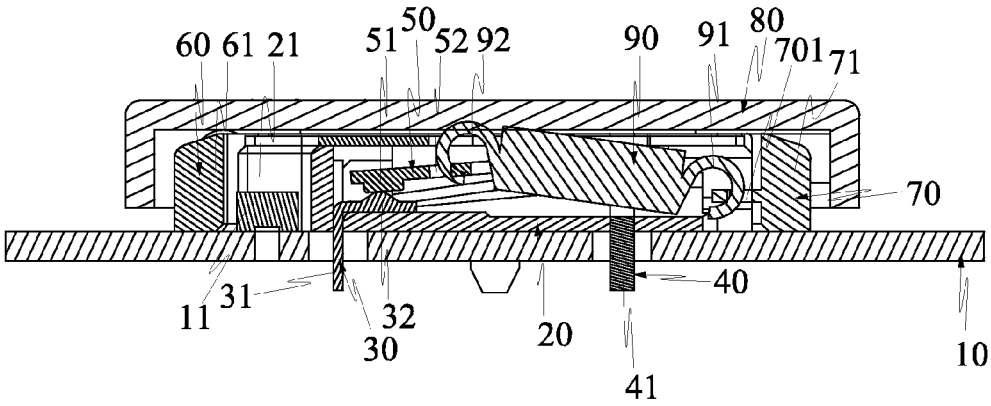
FIG. 9 is a sectional view according to the first embodiment of the present invention.

Embodiments of the present invention will now be described, by way of example only, with reference to the accompanying drawings.

As shown in FIG. 1 to FIG. 9, the ultra-thin keyboard switch according to a first embodiment of the present invention comprises a PCB (printed circuit board) board 10, a base 20, a static contact plate 30, a support plate 40, a movable contact plate 50, a lower frame 60, an upper frame 70, and a keyboard cap 80.

The PCB board 10 comprises an LED (light emitting diode) 11 thereon. The base 20 is disposed on the PCB board 10. The base 20 has a notch 21 thereon. The LED 11 is located in the notch 21.

The static contact plate 30 and the support plate 40 are separated from each other and disposed on the base 20. The static contact plate 30 has a first welding leg 31 and a static contact 32. The support plate 40 has a second welding leg 41. The second welding leg 41 and the first welding leg 31 extend out of the base 20, and are welded and electrically connected to the PCB board 10.

One end of the movable contact plate 50 is in contact with and electrically connected with the support plate 40. Another end of the movable contact plate 50 has a movable contact 51. The movable contact 51 is located above the static contact 32.

The upper frame 70 and the lower frame 60 intersect each other and are pivotally connected together. A lower end of the upper frame 70 and a lower end of the lower frame 60 are pivotally connected to two ends of the base 20, respectively. An upper end of the upper frame 70 and an upper end of the lower frame 60 are pivotally connected to two ends of the bottom of the keyboard cap 80, respectively. The upper frame 70 and the lower frame 60 are assembled to form an X-shaped configuration to bring the movable contact plate 50 to move. When the upper frame 70 and the lower frame 60 are in a folded state, the movable contact 51 and the static contact 32 are in contact with each other and electrically connected. The movable contact plate 50 is provided with an elastic member 90 to restore the movable contact plate 50 for the movable contact 51 to be away from the static contact 32.

Specifically, in this embodiment, the lower frame 60 and the upper frame 70 are in a U shape. The lower frame 60 comprises a first transverse rod 61 and two first connecting rods 62. The first transverse rod 61 has first pivots 63 extending out from two ends of the first transverse rod 61. The first pivots 63 are pivotally connected to the keyboard cap 80. The two first connecting rods 62 are parallel to each other and respectively connected to the two ends of the first transverse rod 61. The two first connecting rods 62 have second pivots 64 extending out from inner sides of rear ends of the two first connecting rods 62. The second pivots 64 are pivotally connected to the base 20. The upper frame 70 comprises a second transverse rod 71 and two second connecting rods 72. The second transverse rod 71 has third pivots 73 extending out from two ends of the second transverse rod 71. The third pivots 73 are pivotally connected to the keyboard cap 80. The two second connecting rods 72 are parallel to each other and respectively connected to the two ends of the second transverse rod 71. The two second connecting rods 72 have fourth pivots 74 extending out from inner sides of rear ends of the two second connecting rods 72. The fourth pivots 74 are pivotally connected to the base 20. The two second connecting rods 72 are located corresponding to the inner sides of the two first connecting rods 62, respectively. Middle portions of the two second connecting rods 72 are pivotally connected to middle portions of the two first connecting rods 62, respectively. In this embodiment, the two second connecting rods 72 have sixth pivots 75 extending out from outer sides of the middle portions of the two second connecting rods 72. The first connecting rods 62 have pivot holes 65 corresponding in position to the sixth pivots 75. The sixth pivots 75 are pivotally connected to the pivot holes 65.

The rear ends of the first connecting rods 62 have first engaging troughs 601 thereon. Inner sides of front ends of the first connecting rods 62 have second engaging troughs 602. In the folded state, front portions of the second connecting rods 72 are engaged in the first engaging troughs 601 and rear portions of the second connecting rods 72 are engaged in the second engaging troughs 602, so that the product is thinner.

The base 20 has a cavity 22, two first pivot troughs 23, and two second pivot troughs 24. The two first pivot troughs 23 and the two second pivot troughs 24 are disposed at four corners of the base 20. The second pivots 64 and the fourth pivots 74 are engaged in the first pivot troughs 23 and the second pivot troughs 24. The base 20 is provided with an upper cover 10' thereon. The upper cover 10' renders the second pivots 64 and the fourth pivots 74 confined in the first pivot troughs 23 and the second pivot troughs 24, respectively. The movable contact plate 20 is embedded in the cavity 22 and located under the upper cover 10'. Two opposing side boards of the upper cover 10' are formed with buckle holes 11'. The base 20 are provided with buckle portions 25 corresponding to the buckle holes 11'. The buckle portions 25 are buckled to the buckle holes 11', such that the upper cover 10' is mounted on the base 20. The top end of the support plate 40 has a positioning portion 42. The upper cover 10' has a positioning hole 12'. The positioning portion 42 is inserted and positioned in the positioning hole 12'. The two side boards of the upper cover 10' have insertion legs 13' extending downward. The insertion legs 13' are welded and connected to the PCB board 10.

The bottom of the keyboard cap 80 has third pivot troughs 81 and fourth pivot troughs 82. The first pivots 63 and the third pivots 73 are engaged in the third pivot troughs 81 and the fourth pivot troughs 82, respectively.

In this embodiment, the elastic member 90 is a tension spring. The tension spring is exposed out of the upper cover 10'. The tension spring has a first hook portion 91 and a second hook portion 92 at two ends thereof. The second transverse rod 71 of the upper frame 70 has a first hook hole 701. The first hook portion 91 is hooked to the first hook hole 701. The movable contact plate 50 has a second hook hole 52 thereon. The second hook portion 92 is hooked to the second hook hole 52.

In addition, the base 20 is embedded in the X-shaped configuration, so the product is smaller in size.

To assemble the present invention, the static contact plate 30 and the support plate 40 are inserted and connected to the corresponding positions of the base 20 from top to bottom. After that, the movable contact plate 50 is placed in the cavity 22 and in contact with the support plate 40. Then, the upper frame 70 and the lower frame 60 are intersected and pivotally connected with each other. The second pivots 64 and the fourth pivots 74 are engaged in the first pivot troughs 23 and the second pivot troughs 24, respectively. Subsequently, the first hook portion 91 of the tension spring is hooked to the first hook hole 701, and the second hook portion 92 of the tension spring is hooked to the second hook hole 52. The upper cover 10' is buckled from up to down and mounted on the base 20. Then, the keyboard cap 80 is assembled, such that the first pivots 63 and the third pivots 73 are pivotally connected to the third pivot troughs 81 and the fourth pivot troughs 82, respectively.

When the keyboard cap 80 is pressed, the upper frame 70 and the lower frame 60 are moved downward to be folded together. At the same time, the elastic member 90 is pulled. The movable contact plate 50 is moved downward, such that the movable contact 51 is in contact with and electrically connected with the static contact 32. When the keyboard cap 80 is released, the elastic member 90 will restore. By the action of the elastic member 90, the upper frame 70 and the lower frame 60 expand upward and the keyboard 80 is restored upward. In the meanwhile, the movable contact plate 50 is also restored upward, such that the movable contact 51 is away from the static contact 32.

Figure 10:
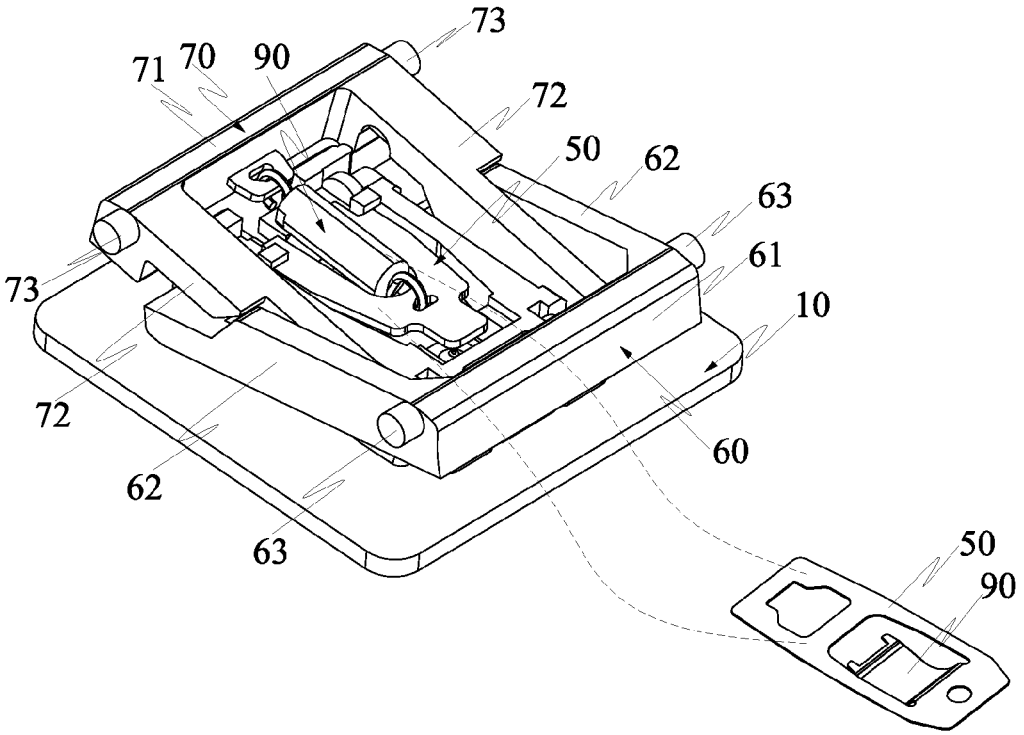
FIG. 10 is a partially assembled perspective view according to a second embodiment of the present invention.

FIG. 10 shows a second embodiment of the present invention. The second embodiment is substantially similar to the first embodiment with the exceptions described hereinafter.

In this embodiment, the elastic member 90 is an elastic plate which is integrally formed on the movable contact plate 50. The movable contact plate 50 is connected to the lower frame 60.

The assembly procedure and use of the second embodiment are the same as the first embodiment, and won't be described in detail.

Figure 11:
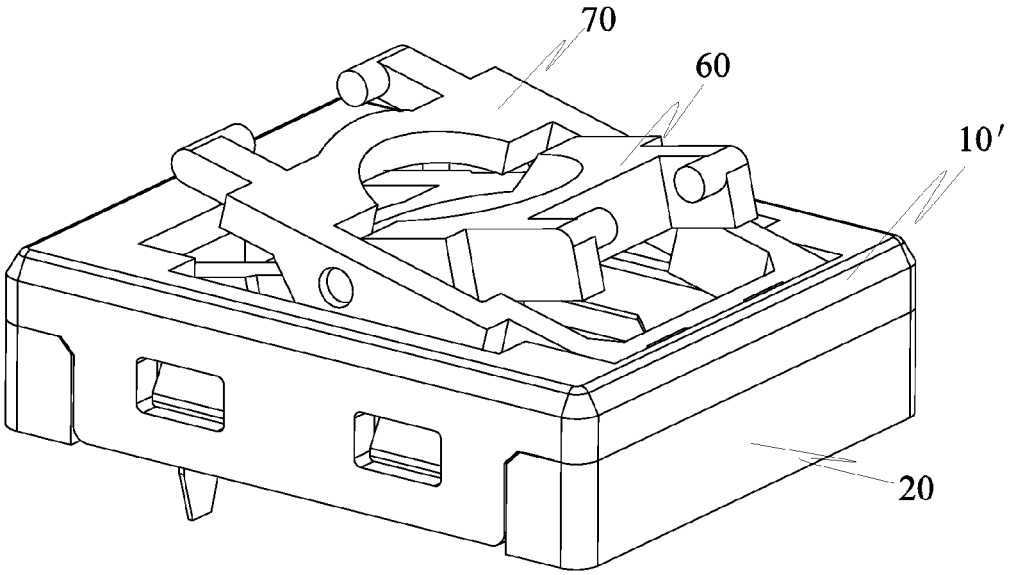
FIG. 11 is a partially assembled perspective view according to a third embodiment of the present invention.

FIG. 11 shows a third embodiment of the present invention. The third embodiment is substantially similar to the first embodiment with the exceptions described hereinafter.

The base 20 is located under the X-shaped configuration. Both the upper frame 70 and the lower frame 60 extend out of the upper cover 10'.

The assembly procedure and use of the third embodiment are the same as the first embodiment, and won't be described in detail.

The feature of the present invention is that the upper frame and the lower frame are intersected and pivotally connected with each other to form the X-shaped configuration to bring the movable contact plate to move, instead of the conventional guide post. The thickness of the product can be reduced to be thin. No matter where the user's finger is at any position of the keyboard, the upper frame and the lower frame are linked to bring the movable contact plate to move. The present invention can be pressed stably, so that the connection of the static contact plate and the movable contact plate is more sensitive and the product can be used more conveniently.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. An ultra-thin keyboard switch, comprising a base, a static contact plate, a support plate, a movable contact plate, a lower frame, an upper frame, and a keyboard cap; the static contact plate and the support plate being separated from each other and disposed on the base, the static contact plate having a first welding leg and a static contact, the support plate having a second welding leg, the second welding leg and the first welding leg extending out of the base; one end of the movable contact plate being in contact with and electrically connected with the support plate, another end of the movable contact plate having a movable contact, the movable contact being located above the static contact; the upper frame and the lower frame intersecting each other and being pivotally connected together, a lower end of the upper frame and a lower end of the lower frame being pivotally connected to two ends of the base, respectively, an upper end of the upper frame and an upper end of the lower frame being pivotally connected to two ends of a bottom of the keyboard cap, respectively, the upper frame and the lower frame being assembled to form an X-shaped configuration to bring the movable contact plate to move, when the upper frame and the lower frame being in a folded state, the movable contact and the static contact being in contact with each other and electrically connected, the movable contact plate being provided with an elastic member to restore the movable contact plate for the movable contact to be away from the static contact.

2. The ultra-thin keyboard switch as claimed in claim 1, wherein the elastic member is a tension spring, one end of the tension spring being hooked to the upper frame, another end of the tension spring being hooked to the movable contact plate.

3. The ultra-thin keyboard switch as claimed in claim 1, wherein the elastic member is an elastic plate which is integrally formed on the movable contact plate, the movable contact plate being connected to the lower frame.

4. The ultra-thin keyboard switch as claimed in claim 1, wherein the base is embedded in the X-shaped configuration.

5. The ultra-thin keyboard switch as claimed in claim 1, wherein the base is located under the X-shaped configuration.

6. The ultra-thin keyboard switch as claimed in claim 1, wherein the lower frame and the upper frame are in a U shape, the lower frame comprising a first transverse rod and two first connecting rods, the first transverse rod having first pivots extending out from two ends of the first transverse rod, the first pivots being pivotally connected to the keyboard cap, the two first connecting rods being parallel to each other and respectively connected to the two ends of the first transverse rod, the two first connecting rods having second pivots extending out from inner sides of rear ends of the two first connecting rods, the second pivots being pivotally connected to the base, the upper frame comprising a second transverse rod and two second connecting rods, the second transverse rod having third pivots extending out from two ends of the second transverse rod, the third pivots being pivotally connected to the keyboard cap, the two second connecting rods being parallel to each other and respectively connected to the two ends of the second transverse rod, the two second connecting rods having fourth pivots extending out from inner sides of rear ends of the two second connecting rods, the fourth pivots being pivotally connected to the base, the two second connecting rods being located corresponding to the inner sides of the two first connecting rods, respectively, middle portions of the two second connecting rods being pivotally connected to middle portions of the two first connecting rods.

7. The ultra-thin keyboard switch as claimed in claim 6, wherein the rear ends of the first connecting rods have first engaging troughs thereon, inner sides of front ends of the first connecting rods having second engaging troughs, when in the folded state, front portions of the second connecting rods being engaged in the first engaging troughs and rear portions of the second connecting rods being engaged in the second engaging troughs.

8. The ultra-thin keyboard switch as claimed in claim 6, wherein the two second connecting rods have sixth pivots extending out from outer sides of the middle portions of the two second connecting rods, the first connecting rods having pivot holes corresponding in position to the sixth pivots, the sixth pivots being pivotally connected to the pivot holes.

9. The ultra-thin keyboard switch as claimed in claim 6, wherein the base has two first pivot troughs and two second pivot troughs, the second pivots and the fourth pivots being engaged in the first pivot troughs and the second pivot troughs, the base being provided with an upper cover thereon, the upper cover rendering the second pivots and the fourth pivots confined in the first pivot troughs and the second pivot troughs, respectively, the movable contact plate being located under the upper cover.

10. The ultra-thin keyboard switch as claimed in claim 6, wherein the bottom of the keyboard cap has third pivot troughs and fourth pivot troughs, the first pivots and the third pivots being engaged in the third pivot troughs and the fourth pivot troughs, respectively.

* * * * *